United States Patent [19]

Schieman

[11] Patent Number: 4,717,489

[45] Date of Patent: Jan. 5, 1988

[54] HEAVY DUTY DIESEL ENGINE OIL BLEND

[75] Inventor: Richard D. Schieman, Rocky River, Ohio

[73] Assignee: Standard Oil Company, Cleveland, Ohio

[21] Appl. No.: 608,674

[22] Filed: May 9, 1984

[51] Int. Cl.[4] ..... C10G 41/00

[52] U.S. Cl. ..... 252/32.7 E; 208/19

[58] Field of Search ..... 252/32.7 E; 208/19

[56] References Cited

U.S. PATENT DOCUMENTS 3,011,974 12/1961 Henke et al. ..... 208/308
3,595,967 7/1971 Riedel ..... 252/32.7 E
3,873,455 3/1975 Schieman ..... 252/32.7
4,402,841 9/1983 Schieman ..... 252/32.7 E

*Primary Examiner*—John F. Niebling
*Attorney, Agent, or Firm*—Larry W. Evans; David J. Untener; Bruce E. Harang

[57] ABSTRACT

A blend of solvent-extracted neutral (SEN) oils is described which is particularly useful in formulating heavy duty motor oils for lubrication of both diesel and gasoline engines. SEN 100, 140, and 300 are combined in required proportions to meet specified viscosity and boiling range characteristics. This base oil blend, upon the addition of lubricant additives to form a finished motor oil, provides the basis of an SAE 10W-30 grade CD/SF oil that meets the specifications for lubrication of both turbocharged diesel and gasoline engines.

4 Claims, No Drawings

HEAVY DUTY DIESEL ENGINE OIL BLEND

BACKGROUND OF THE INVENTION

1. Field of the Invention

This invention relates to a motor oil composition for internal combustion engines. More particularly, this invention relates to a blend of three solvent-extracted neutral (SEN) oils as a base oil used in a multi-grade heavy duty motor oil. In one aspect, this invention forms the basis of an SAE 10W-30 grade CD/SF oil that meets specifications for lubrication of both turbocharged diesel and gasoline engines.

2. Discussion of the Art

Lubricating oils must provide minimal frictional wear in an engine over a wide range of operating temperatures. These engine temperatures can range from below freezing during cold weather starting to above 400° F. (200° C.) during severe usage.

A continuing problem in the art is formulating a multi-grade oil which will maintain all of the desired characteristics, i.e. low viscosity at cold starting temperatures and high viscosity to decrease consumption at operating engine temperatures, without sacrificing or compromising any of these features. These qualities are critical for satisfactory performance under severe conditions, such as in turbocharged diesel engines used to power large trucks and construction equipment.

Merely blending a base oil that meets the viscometric requirements of a multi-grade oil does not mean that the oil will survive the severe environment of turbocharged diesel engine lubrication over an extended period. The oil must also meet the requirements of engine tests used to qualify for various SAE ratings and commercial marketing. A blend of various base oils and additives is usually necessary to provide both low temperature cranking properties and thermal stability at higher temperatures.

The results of engine tests are usually not predictable from the viscometric data of the base oil. The addition of significant amounts of synthetic additives can alter the delicate balance of the base oil blend, with the result that the base oil blend itself must be adjusted to compensate for the viscosity characteristics of the additives. Occasionally this problem is so pronounced that incorporating additives to correct one defect, such as poor oil consumption, can result in another defect, such as a failure to meet viscosity requirements. A common objective is to formulate a base oil blend with minimal dependence on additive chemistry.

It is generally accepted that 10W-30 engine oils will provide advantages in cold starting and fuel savings over 15W-40 engine oils. However, wear control and consumption problems often arise because of the limitations of the base oil. 10W-30 oils have previously required relatively large amounts of costly lubricant additives and viscosity index improvers to correct such deficiencies. It is therefore unusual to find a base oil blend that allows a 10W-30 oil to approach the performance standards of a 15W-40 oil.

Lubricants are often blended to meet the specific requirements of a limited type of engine and a certain range of operating conditions. For example, an oil designed for heavy duty diesel engines would not be expected to give good performance on gasoline engines. It is unique that a 10W-30 oil can pass heavy duty diesel engine tests. It is of special significance that this same oil can achieve an SF rating for gasoline engines.

SUMMARY OF THE INVENTION

The invention is directed to a blend of solvent extracted neutral (SEN) oils suitable as a base oil for the manufacture of a multi-grade motor oil which demonstrates minimal oil consumption and stability at high temperatures. The base oil blend comprises:

(a) From 45 to 55 volume percent of SEN 100;

(b) Up to 35 percent of SEN 140;

(c) At least 14 percent of SEN 300.

The blend should have a 210° F. viscosity of from 4.3 to 5.0 centistokes and a 100° F. viscosity of from 25 to 30 centistokes. No more than 10 percent of the blend boils at 675° F., no more than 50 percent boils at 760° F., and the remainder of the blend boils below 970° F.

DETAILED DESCRIPTION

This invention concerns a combination of SEN oils blended in specified proportions and having requiring certain viscosity and boiling range characteristics. This combination of SEN oils is suitable as a base oil blend for a SAE 10W-30 motor oil which exhibits performance similar to a 15W-40 blend, a much higher viscosity oil. The finished motor oil demonstrates qualities which are rarely found concurrently in a heavy duty motor oil: improved fuel economy, oil consumption control, minimal engine deposits, and good wear control.

Base Oil

The base oil is a homogeneous mixture of solvent-extracted neutral (SEN) oils which are predominantly saturated, although they contain certain amounts of aromatic compounds. SEN oils are well-known standard mineral oil stocks derived from the vacuum distillation column of a refinery. They have been used for many years as a component of lubricating oils, and it is well known to formulate multi-grade motor oils using different SEN oils as the base stock. Often more than one SEN oil is blended to produce a composite SEN oil having certain characteristics of each SEN component.

One objective of the invention was to produce a viscometrically acceptable oil which also showed minimal wear at low temperatures and minimal deposits at high temperatures without suffering excessive consumption. In trying to meet this difficult objective, several candidate oils which met all of the viscometric characteristics nevertheless failed other tests such as the Caterpillar 1G2 engine test designed to evaluate engine deposits resulting from thermal and oxidation decomposition of the oil.

It was therefore unexpected to discover that a base oil blend which had a large amount of low-boiling (SEN 100) oil necessary to meet 10W characteristics could nevertheless meet the oil consumption test requirements.

Blend Proportions

The SEN oil combination which has been found to be particularly useful in accordance with the present invention contains SEN 100, SEN 140, and SEN 300. "SEN 100" means a solvent extracted neutral oil having a viscosity of 3.65 to 3.8 centistokes (cSt) at 210° F. and 18.6 to 18.9 cSt at 100° F. "SEN 140" has a viscosity of 4.8 to 5.0 cSt at 210° F. and 30.0 to 30.7 cSt at 100° F.

"SEN 300" has a viscosity of 8.0 to 8.13 cSt at 210° F. and 66.8 to 68 cSt at 100° F.

The ratio of SEN 140 to 300 should be between 2:1 and 1:1. Preferably, SEN 140/SEN 300 is nearly 2:1.

The base oil contains a surprisingly high amount of SEN 100 for a base oil which is capable of passing the Caterpillar 1G2 thermal decomposition test. The base oil is blended with the following limitations:

(a) From 45 to 55 volume percent of SEN 100;

(b) Up to 35 percent of SEN 140;

(c) At least 14 percent of SEN 300.

The completed base oil blend should have a 210° F. viscosity of from 4.3 to 5.0 centistokes and a 100° F. viscosity of from 25 to 30 centistokes. No more than 10 percent of the blend boils at 675° F., no more than 50 percent boils at 760° F., and the remainder of the blend boils below 970° F.

The exact chemical composition of the base oils will depend upon the source of the crude oil and the refinery processing steps used to obtain the SEN oil fractions. For this reason, ranges are given for the proportions of SEN oils. Within the ranges taught in this patent, one skilled in the art can produce a base oil blend, using conventional crude oils and refining techniques, which meets the viscosity and distillation requirements.

In commercial practice, base oils are combined with viscosity index (V.I.) improvers if needed and synthetic additives which function as detergents, dispersants, and corrosion inhibitors. While these V.I. improvers and additives are necessary to achieve optimal performance of the completed motor oil, it is axiomatic that no amount of additives can correct major errors or deficiencies in the base oil composition or blending proportions.

This invention relies on the discovery that certain SEN oils, combined in a narrow range of proportions to produce a base oil, will result in a superior oil capable of meeting SAE 10W-30 specifications and SF/CD ratings requiring only minimal amounts of additives. Although additives and V.I. improvers are contemplated for inclusion with the inventive base oil, as in any commercial motor oil formulation, they form no part of this invention. The following examples are provided to further illustrate the invention.

SPECIFIC EMBODIMENTS

A base oil suitable for a 10W-30 motor oil was obtained by mixing solvent extracted neutral oils in the stated proportions, expressed as a percentage of the base oil by volume:

| | |
|---|---|
| SEN 100 | 51.1 |
| SEN 140 | 32.7 |
| SEN 300 | 16.2 |

Analysis of a portion of this blend (before mixing with any lubricant additives) showed a 210° F. viscosity of 4.63 centistokes and a 100° F. viscosity of 27.2 centistokes. Distillation tests indicated that 10 percent of the blend boiled at 677° F., 50 percent boiled at 768° F., and the boiling temperature endpoint was 953° F.

Before performance qualification testing was begun, lubricant additives were added to the base oil. These additives are preblended and are readily available from lubricant additive suppliers.

The SAE 10W-30 motor oil formulation to be tested contained the inventive blend of SEN oils described above, together with other lubricant additives. The components are expressed as a percentage of the finished motor oil by volume:

| | |
|---|---|
| SEN Base Oil | 75.5 |
| Detergent/Dispersant/ Inhibitor Additive | 16.5 |
| Viscosity Index Improver | 7.5 |
| Pour Point Depressant | 0.5 |

The detergent/dispersant/inhibitor additive was obtained from the Lubrizol Corporation under the designation 3947A. The specific composition of this additive is unknown to the inventor, but it is generally described as containing polyalkenyl succinimide-succinic ester dispersants, low molecular weight primary zinc dithiophosphate, an ashless anti-wear component, magnesium phenate and calcium sulfonate. The V.I. improver used is an olefin copolymer, and the pour depressant is a polymethacrylate.

The engine test data demonstrated that the 10W-30 oil made with the inventive base oil blend had a unique ability to control engine wear, deposits, and consumption. These data were also compared to data from several 15W-40 formulations which, because they are heavier oils, would be expected to provide better wear control and lower consumption than the less viscous 10W-30 oil.

Cummins NTC 400

The Cummins NTC 400 Diesel engine test measures oil consumption by comparing the percent increase in consumption from the 20–40 hour interval of engine operation to that of the 180–200 hour interval.

The data show that the 10W-30 formulation more than met the consumption requirements for the NTC 400 test. Surprisingly, it performed even better than Blend A, a 15W-40 formulation containing an additive package very similar to the 10W-30. Results were far superior to Blend B, a commercial 15W-40 oil. The maximum increase permitted under the NTC 400 test is 100 percent.

TABLE 1

| | NTC 400 Engine Test Oil Consumption | | |
|---|---|---|---|
| Run time interval | 10W-30 | Comp. A | Comp. B |
| 20–40 Hours | 0.1 | 0.08 | 0.121 |
| 180–200 Hours | 0.185 | 0.153 | 0.367 |
| % Increase | 85 | 91 | 203 |

SF Testing

It is highly unexpected that an oil designed to meet heavy duty diesel engine requirements necessary for the API rating "CD" could also pass the gasoline engine tests necessary for an "SF" rating. However, the 10W-30 formulation met and often exceeded the specifications to qualify as an SF oil.

TABLE 2

| Test | 10W-30 Data | Performance Requirements |
|---|---|---|
| CRC L-38 | | |
| Bearing Weight Loss, mg. | | |
| Piston Varnish | | |
| SEQUENCE V-D | | |
| Average Engine Sludge | 20.0 | 40 max |
| Average Engine Varnish | 9.8 | 9.0 min |

TABLE 2-continued

| Test | 10W-30 Data | Performance Requirements |
|---|---|---|
| Average Piston Varnish | 9.4 | 9.4 min |
| Oil Ring Clogging | 6.7 | 6.7 min |
| Oil Screen Clogging | 7.7 | 6.7 min |
| Compression Ring Sticking | None | None |
| Cam Wear, mils | | |
| Maximum | 1.1 | 2.5 max |
| Average | 0.9 | 1.0 max |
| SEQUENCE IID | | |
| Average Engine Rust | 8.9 | 8.5 min |
| Stuck Lifters | None | None |
| SEQUENCE IIID | | |
| 40° C. Viscosity Increase at 64 hours, Δ | 109 | 375 max |
| Average Engine Sludge | 9.6 | 9.2 min |
| Average Piston Varnish | 9.5 | 9.2 min |
| Avg. Oil Ring Land Varnish | 9.0 | 4.8 min |
| Valve Train Wear | | |
| Maximum, inches | 0.0052 | 0.0080 |
| Average, inches | 0.0028 | 0.0040 |
| Oil Consumption, quarts | 5.97 | 6.38 max |

Caterpillar 1G2

The Caterpillar 1G2 test determines the amount of ring sticking, ring and cylinder wear, and accumulation of piston deposits. The test is run for a total of 480 hours on a 133.5 CID supercharged Diesel engine at 1800 rpm with 5850 BTU/minute 0.35 percent minimum by weight sulfur fuel input, with the oil temperature maintained at 205° F. (96° C.).

Data from this test show that the 10W-30 oil readily meet the 1G2 tests with no ring sticking or tightness, top groove filling of 48 percent, and a total weighted demerit of 106.1.

Mack T-6

The Mack T-6 test is a standard procedure designed to evaluate oil thickening, piston deposits, oil consumption, and piston ring wear. It uses a 672 CID six cylinder turbocharged engine at full power at varying rpm levels of 1400, 1800, and 2100 for a total of 600 hours. The following Table 3 presents data from the Mack T-6 engine test.

The 10W-30 formulation contains the inventive SEN base oil blend and Lubrizol additives. Comparison A is a 15W-40 formulation containing the same Lubrizol additive and V.I. improver, while comparison B is another 15W-40 formulation containing different additives and V.I. improvers. Comparison C lists the reference oil values, which are included to judge performance of the 10W-30 oil relative to the chosen standard for the Mack T-6 test.

Oil consumption is measured in pounds per brake horsepower hour. Proudness is a measure of deposits, expressed in inches. Viscosity increase is measured in centistokes at 210° F.

TABLE 3

| | Mack T-6 Engine Test | | | | |
|---|---|---|---|---|---|
| | 10W-30 | Comp A | Comp B | Comp C | Limits |
| Oil Consumption | 0.00067 | 0.00051 | 0.0009 | 0.0011 | 0.0014 Max |
| Ring Wt. Loss, gms. 1st & 2nd Rings | 0.278 | 0.329 | 0.325 | 0.184 | 0.350 Max |
| Proudness | 0.007 | 0.008 | 0.005 | 0.005 | 0.02 Max |
| Viscosity Increase | 6.4 | 6.9 | 5.5 | 5.4 | 14 Max |
| Demerits | 649 | 515 | 457 | 514 | 650 Max |

I claim:

1. A blend of solvent extracted neutral (SEN) oils suitable as a base oil for the manufacture of a multigrade motor oil which demonstrates minimal oil consumption and stability at high temperatures, the base oil blend comprising:

A. from 45 to 55 volume percent of SEN 100;

B. an amount up to 35 volume percent of SEN 140;

C. at least 14 volume percent of SEN 300; and wherein the blend has a 210° F. viscosity of from 4.3 to 5.0 centistokes and a 100° F. viscosity of from 25 to 30 centistokes; and wherein no more than 10 percent of the blend boils at 675° F., no more than 50 percent boils at 760° F., and the remainder of the blend boils below 970° F.

2. The blend of claim 1 in which the ratio of SEN 140 to SEN 300 is about 2:1.

3. The blend of claim 1 containing about 51 volume percent SEN 100, about 33 volume percent SEN, 140, and about 16 volume percent SEN 300.

4. The blend of claim 1 in which the blend has a 210° F. viscosity of about 4.6 centistokes and a 100° F. viscosity of about 27 centistokes.

* * * * *